US007728716B2

(12) United States Patent
Yu et al.

(10) Patent No.: US 7,728,716 B2
(45) Date of Patent: Jun. 1, 2010

(54) PIEZOELECTRIC BUZZER

(75) Inventors: Cheng-Sheng Yu, Kaohsiung (TW); Huey-Lin Hsieh, Yung-Kang (TW); Tsai-Kun Huang, Ping-Tung (TW); Jyh-Jang Wey, Min-Hsiung Hsiang (TW); Wu-Song Chuang, Ying-Ko Chen (TW); Chun-Jung Lin, Taoyuan (TW)

(73) Assignee: China Steel Corporation, Kaohsiung (TW)

( * ) Notice: Subject to any disclaimer, the term of this patent is extended or adjusted under 35 U.S.C. 154(b) by 265 days.

(21) Appl. No.: 11/882,413

(22) Filed: Aug. 1, 2007

(65) Prior Publication Data

US 2009/0033473 A1 Feb. 5, 2009

(51) Int. Cl.
*G08B 3/10* (2006.01)

(52) U.S. Cl. ..... 340/384.6; 310/330; 310/311

(58) Field of Classification Search ..... 340/384.6; 310/338, 358, 324, 332, 300, 311, 328, 330, 310/331, 320, 317, 323.06, 327
See application file for complete search history.

(56) References Cited

U.S. PATENT DOCUMENTS 4,429,247 A * 1/1984 Feldman ..... 310/322
4,600,851 A * 7/1986 Isayama et al. ..... 310/324
4,631,436 A * 12/1986 Edinger et al. ..... 310/332
4,965,483 A * 10/1990 Abe et al. ..... 310/324
4,989,302 A * 2/1991 Abe et al. ..... 29/25.35
5,321,761 A * 6/1994 Kitanishi ..... 381/190
5,625,248 A * 4/1997 Saito et al. ..... 310/324
5,925,970 A * 7/1999 Unami et al. ..... 310/328
7,548,013 B2 * 6/2009 Brosch et al. ..... 310/338
2005/0258719 A1 * 11/2005 Sugahara et al. ..... 310/365
2007/0001553 A1 * 1/2007 Kawada et al. ..... 310/358
2007/0247028 A1 * 10/2007 Brosch et al. ..... 310/338
2009/0033473 A1 * 2/2009 Yu et al. ..... 340/384.6
2009/0273248 A1 * 11/2009 Schwaiger ..... 310/71

* cited by examiner

*Primary Examiner*—Davetta W Goins
*Assistant Examiner*—Hoi C Lau
(74) *Attorney, Agent, or Firm*—Davidson Berquist Jackson & Gowdey LLP

(57) ABSTRACT

A piezoelectric buzzer includes a housing unit, a buzzer unit, and first and second terminals. The housing unit includes first and second housings coupled together. The second housing includes a base plate and a pair of spaced apart insert seats, each of which protrudes inwardly from the base plate toward the first housing and is formed with an insert hole. The buzzer unit is disposed in the resonant chamber and includes a vibrating plate and a piezoelectric plate attached to the vibrating plate. The first and second terminals are inserted respectively into the insert holes of the insert seats, and have a respective connection section extending outwardly of the housing unit, and a respective extending section abutting against a respective one of the vibrating plate and the piezoelectric plate.

4 Claims, 4 Drawing Sheets

PIEZOELECTRIC BUZZER

BACKGROUND OF THE INVENTION

1. Field of the Invention

The invention relates to a buzzer, more particularly to a piezoelectric buzzer.

2. Description of the Related Art

As shown in FIGS. 1 and 2, a conventional piezoelectric buzzer 1 includes a first housing 11, a second housing 12 coupled to the first housing 11 and cooperating with the first housing 11 to define a resonant chamber 10, a buzzer unit 13 disposed in the resonant chamber 10, and conductive first and second terminals 14, 15.

The second housing 12 includes a base plate 121 and a pair of spaced apart insert seats 122, each of which protrudes outwardly from the base plate 121 and is formed with an insert hole 123. The buzzer unit 13 includes a metallic vibrating plate 131, and a piezoelectric plate 132 made from ceramic material and attached to the vibrating plate 131.

Each of the first and second terminals 14, 15 is inserted into the insert hole 123 in a respective one of the insert seats 122 of the second housing 12. The first terminal 14 has a first connection section 141 extending outwardly of the resonant chamber 10, a first extending section 142 extending from the first connection section 141 into the resonant chamber 10 and extending toward the buzzer unit 13, and a first contact point 143 spot-welded to one end of the first extending section 142 and contacting electrically the vibrating plate 131 of the buzzer unit 13. The second terminal 15 has a second connection section 151 extending outwardly of the resonant chamber 10, a second extending section 152 extending from the second connection section 151 into the resonant chamber 10 and extending toward the buzzer unit 13, and a second contact point 153 spot-welded to one end of the second extending section 152 and contacting electrically the piezoelectric plate 132 of the buzzer unit 13. Application of an alternating current voltage to the vibrating plate 131 and the piezoelectric plate 132 via the first and second connection sections 141, 151 will cause mechanical distortion of the vibrating plate 131 due to the piezoelectric effect, thereby generating sounds.

To firmly position the first and second terminals 14, 15, the insert seats 122 of the second housing 12 are disposed to protrude outwardly from the base plate 121 of the second housing 12 for making the insert holes 123 deeper. However, the outwardly protruding insert seats 122 result in a relatively thick piezoelectric buzzer. The thickness of the conventional piezoelectric buzzer is 6.8 millimeters measured from the first housing 11 to the base plate 121 of the second housing 12, which hinders application to some electronic devices, such as on-board units (OBU) for Electronic Toll Collection (ETC) system (the maximum standard thickness being 6.2 millimeters). Moreover, the relatively large distances between each of the first and second connection sections 141, 151 and the buzzer unit 3 weaken the resilient contact forces of the first and second extending sections 142, 152 for abutting respectively against the vibrating plate 131 and the piezoelectric plate 132, thereby resulting in poor contact quality therebetween. Furthermore, the spot-welding of the first and second contact points 143, 153 results in a relatively complicated and time-consuming manufacturing process for the piezoelectric buzzer.

SUMMARY OF THE INVENTION

Therefore, the object of the present invention is to provide a piezoelectric buzzer with a smaller size, a simpler manufacturing process, and better contact quality between the terminals and the buzzer unit.

Accordingly, a piezoelectric buzzer of the present invention comprises a housing unit, a buzzer unit, and first and second terminals. The housing unit includes a first housing, and a second housing that is coupled to the first housing and that cooperates with the first housing to define a resonant chamber. The second housing includes a base plate and a pair of spaced apart insert seats, each of which protrudes inwardly from the base plate toward the first housing and is formed with an insert hole. The buzzer unit is disposed in the resonant chamber and includes a vibrating plate and a piezoelectric plate attached to the vibrating plate. The first terminal is inserted into the insert hole in one of the insert seats of the second housing, and has a first connection section that extends outwardly of the resonant chamber, and a first extending section that extends from first connection section into the resonant chamber and that abuts against the vibrating plate of the buzzer unit. The second terminal is inserted into the insert hole in the other one of the insert seats of the second housing, and has a second connection section that extends outwardly of the resonant chamber, and a second extending section that extends from the second connection section into the resonant chamber and that abuts against the piezoelectric plate of the buzzer unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
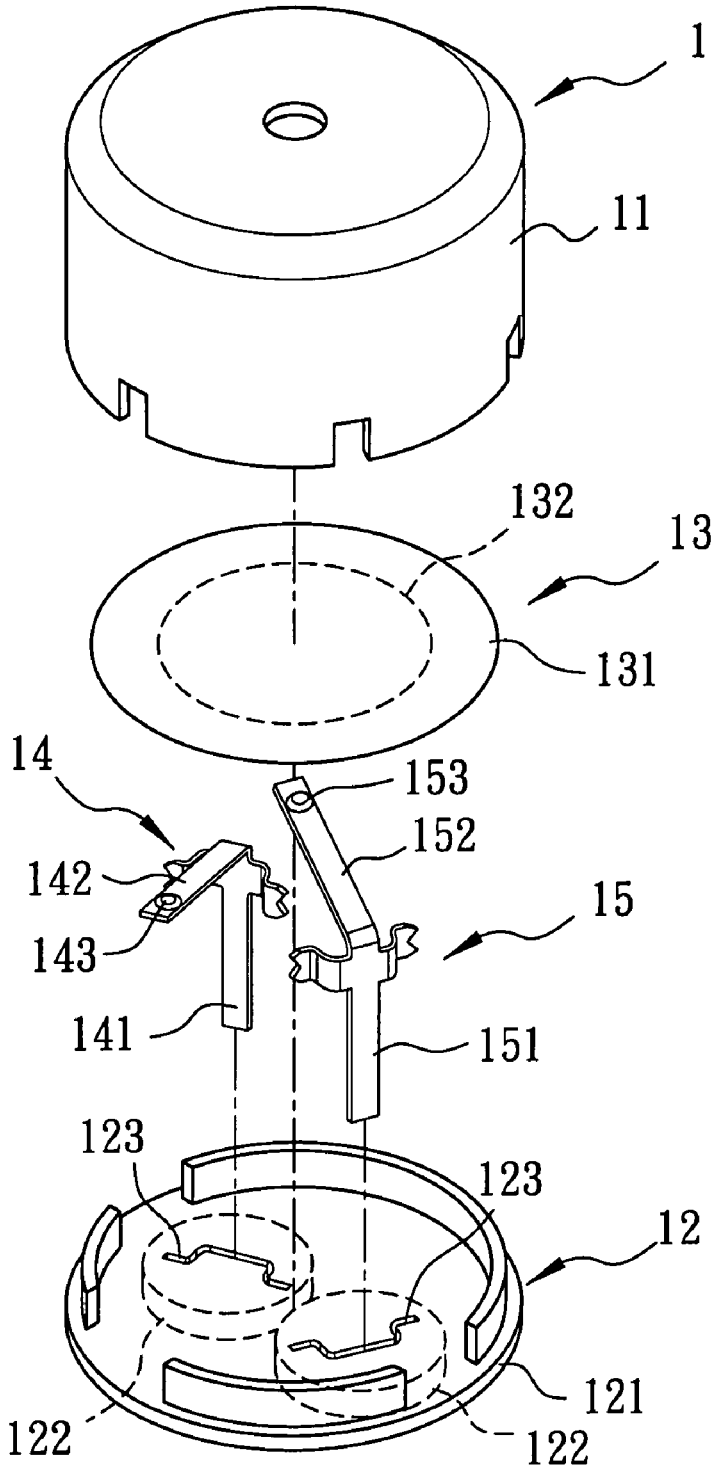
FIG. 1 PRIOR ART
FIG. 1 is an exploded perspective view of a conventional piezoelectric buzzer.
Figure 2:
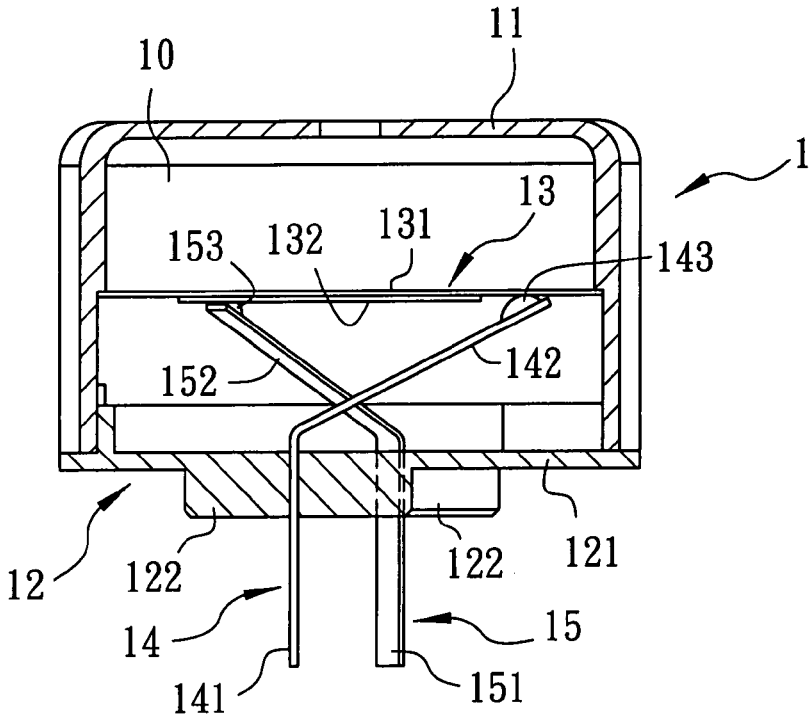
FIG. 2 PRIOR ART
FIG. 2 is a partly sectional view of the conventional piezoelectric buzzer.
Figure 4:
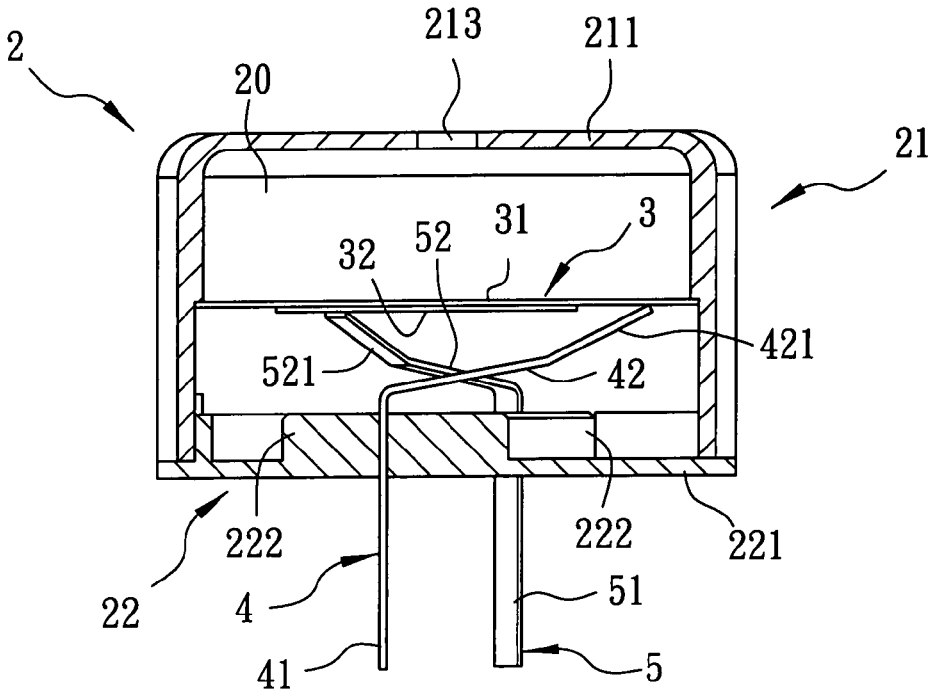
FIG. 4 is a partly sectional view of the preferred embodiment.
Figure 3:
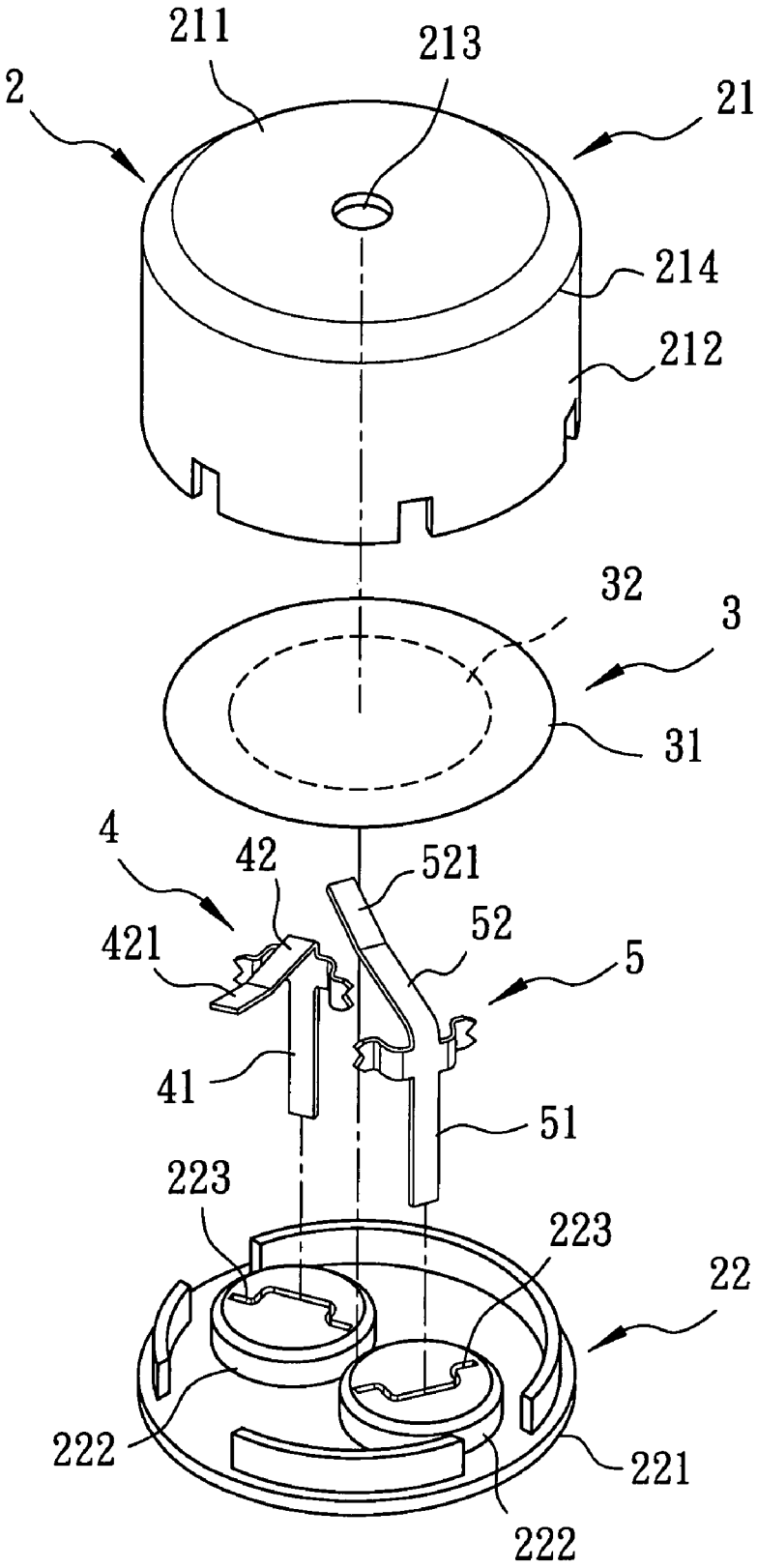
FIG. 3 is an exploded perspective view of a preferred embodiment of a piezoelectric buzzer according to the invention.

As shown in FIGS. 3 and 4, the preferred embodiment of a piezoelectric buzzer according to the present invention is adapted for use with an OBU for ETC system, and comprises a housing unit 2, a buzzer unit 3, and first and second terminals 4, 5.

The housing 2 includes a first housing 21, and a second housing 22 that is coupled to the first housing 21 and that cooperates with the first housing 21 to define a resonant chamber 20. The first housing 21 includes a base wall 211 having a wall periphery 214 and formed with a sound outlet 213, and a surrounding wall 212 extending from the wall periphery 214 of the base wall 211 toward the second housing 22 and coupled to the second housing 22. The second housing 22 includes a base plate 221 and a pair of spaced apart insert seats 222, each of which protrudes inwardly from the base plate 221 toward the first housing 21 and is formed with an insert hole 223.

The buzzer unit 3 is disposed in the resonant chamber 20 and includes a vibrating plate 31 and a piezoelectric plate 32 attached to the vibrating plate 31. In this embodiment, the vibrating plate 31 is made from iron-nickel (Fe—Ni) alloy, and the piezoelectric plate 32 is made from ceramic material that has a dielectric constant of 4000.

The first terminal 4 is inserted into the insert hole 223 in one of the insert seats 222 of the second housing 22 of the housing unit 2, and has a first connection section 41 that extends outwardly of the resonant chamber 20, and a first extending section 42 that extends from the first connection section 41 into the resonant chamber 20 and that abuts against the vibrating plate 31 of the buzzer unit 3. The second terminal 5 is inserted into the insert hole 223 in the other one of the insert seats 222 of the second housing 22, and has a second connection section 51 that extends outwardly of the resonant chamber 20, and a second extending section 52 that extends from the second connection section 51 into the resonant chamber 20 and that abuts against the piezoelectric plate 32 of the buzzer unit 3. In this embodiment, the first extending section 42 has a first bent end segment 421 bent toward the buzzer unit 3, and the second extending section 52 has a second bent end segment 521 bent toward the buzzer unit 3.

Figure 5:
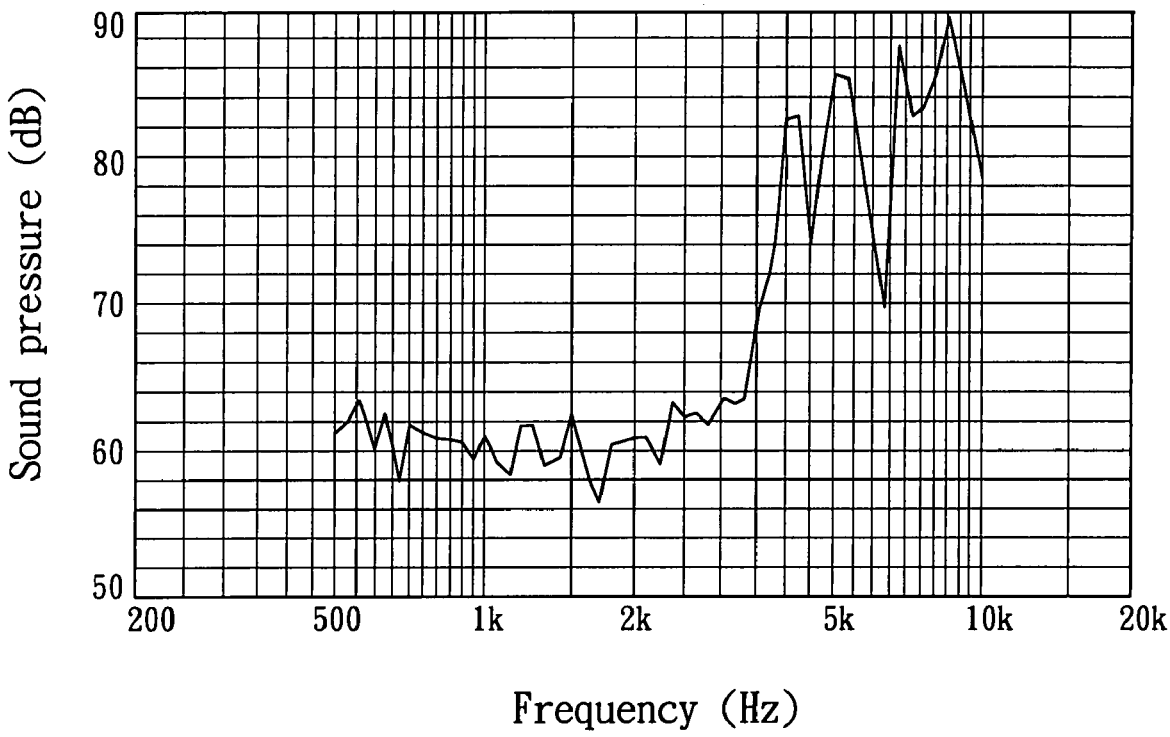
FIG. 5 is a graph illustrating measurement results of the preferred embodiment for sound pressure levels in a frequency range between 500 Hz and 10 kHz.

As shown in FIGS. 4 and 5, the housing unit 2 has a thickness of 6.2 millimeters measured from the base wall 211 of the first housing 21 to the base plate 221 of the second housing 22, which conforms to the standard for an OBU. Moreover, under a drive power of 3 Vrms, the piezoelectric buzzer has sound pressure levels of 83 dB at a frequency of 4000 Hz, and 82.6 dB at a frequency of 5300 Hz, both exceeding the minimum standard of 80 dB.

Compared to the insert seats 122 of the prior art, the insert seats 222 of the second housing 22 of the housing unit 2 that protrude inwardly from the second housing 22 toward the first housing 21 of the housing unit 2 effectively reduce the thickness of the piezoelectric buzzer. After inserting each of the first and second terminals 4, 5 into the insert hole 223 of a respective one of the insert seats 222, the distance between each of the first and second connection sections 41, 51 and the buzzer unit 3 is also shorter than that of the prior art, thereby strengthening the resilient contact forces of the first and second extending sections 42, 52 for abutting respectively and firmly against the vibrating plate 31 and the piezoelectric plate 32. Furthermore, compared to the first and second contact points 143, 153 of the prior art, the first and second bent end segments 421, 521 not only contact the buzzer unit 3 more firmly, but also result in a simpler manufacturing process.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A piezoelectric buzzer comprising:

a first housing, a second housing coupled to said first housing to form and define a resonant chamber there between, said second housing including a base plate and a pair of spaced apart insert seats, each of which protrudes inwardly from an interior of said base plate toward said first housing and is formed with an insert hole;

a buzzer unit disposed in said resonant chamber and including a vibrating plate and a piezoelectric plate attached to said vibrating plate;

a first terminal inserted into said insert hole in one of said insert seats and having a first connection section with one end that extends outwardly from said resonant chamber and an opposite end within the resonant chamber, and a first extending section that extends at an angle from the opposite end of the first connection section a second terminal inserted into said insert hole in the other one of said insert seats and having a second connection section having one end that extends outwardly of said resonant chamber and an opposite end within the resonant chamber, and a second extending section that extends at an angle from the opposite end of the said second connection section; and a bent end segment extending from an inner end of each of the first and second extending sections, each bent end segment being bent obliquely relative to the first and second extending sections so that the bent end segment at the end of the first extending section is directed toward and in resilient contact with the vibrating plate and the bent end segment at the end of the second extending section is directed toward an in resilient contact with the piezoelectric plate.

2. The piezoelectric buzzer as claimed in claim 1, wherein said first housing of said housing unit includes a base wall having a wall periphery and formed with a sound outlet, and a surrounding wall extending from said wall periphery of said base wall toward said second housing and coupled to said second housing.

3. The piezoelectric buzzer as claimed in claim 2, wherein said vibrating plate of said buzzer unit is made from iron-nickel alloy, said piezoelectric plate being made from ceramic material that has a dielectric constant of 4000.

4. The piezoelectric buzzer as claimed in claim 2, wherein said housing unit has a thickness not greater than 6.2 millimeters measured from said base wall of said first housing to said base plate of said second housing.

* * * * *